US010042272B2

(12) United States Patent
Mori et al.

(10) Patent No.: US 10,042,272 B2
(45) Date of Patent: Aug. 7, 2018

(54) ELECTROPHOTOGRAPHIC PHOTOSENSITIVE MEMBER, METHOD FOR PRODUCING THE SAME, PROCESS CARTRIDGE AND ELECTROPHOTOGRAPHIC APPARATUS

(71) Applicant: CANON KABUSHIKI KAISHA, Tokyo (JP)

(72) Inventors: Haruki Mori, Ichikawa (JP); Shinji Takagi, Yokohama (JP); Masaki Nonaka, Toride (JP); Koichi Nakata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/483,252

(22) Filed: Apr. 10, 2017

(65) Prior Publication Data

US 2017/0299971 A1 Oct. 19, 2017

(30) Foreign Application Priority Data

Apr. 14, 2016 (JP) ..... 2016-081295

(51) Int. Cl.

| | |
|---|---|
| ***G03G 5/147*** | (2006.01) |
| ***G03G 5/07*** | (2006.01) |
| ***G03G 5/047*** | (2006.01) |
| ***G03G 5/05*** | (2006.01) |
| ***G03G 5/10*** | (2006.01) |
| ***G03G 5/14*** | (2006.01) |
| ***G03G 5/06*** | (2006.01) |

(52) U.S. Cl.

CPC ..... *G03G 5/071* (2013.01); *G03G 5/047* (2013.01); *G03G 5/0525* (2013.01); *G03G 5/0696* (2013.01); *G03G 5/102* (2013.01); *G03G 5/142* (2013.01)

(58) Field of Classification Search

CPC ..... G03G 5/14717; G03G 5/14734; G03G 5/14786

See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,333,752 | B2 | 2/2008 | Kawahara et al. |
| 7,534,534 | B2 | 5/2009 | Nakata et al. |

(Continued)

FOREIGN PATENT DOCUMENTS

| | | |
|---|---|---|
| JP | H06-135892 | 5/1994 |
| JP | 2002-322125 | 11/2002 |

(Continued)

OTHER PUBLICATIONS

U.S. Appl. No. 15/614,695, Koichi Nakata, filed Jun. 6, 2017.

*Primary Examiner* — Peter L Vajda

(74) *Attorney, Agent, or Firm* — Fitzpatrick Cella Harper and Scinto

(57) ABSTRACT

To provide an electrophotographic photosensitive member being excellent in abrasion resistance and having good electrical characteristics. The surface layer of the electrophotographic photosensitive member contains a copolymerized product of a hole transporting compound having a specified structure and a compound having a specified structure.

9 Claims, 3 Drawing Sheets

(56) References Cited

U.S. PATENT DOCUMENTS

| | | | | |
|---|---|---|---|---|
| 7,732,113 | B2 | 6/2010 | Nakamura et al. | |
| 7,910,274 | B2 | 3/2011 | Tanaka et al. | |
| 8,088,541 | B2 | 1/2012 | Tanaka et al. | |
| 8,343,699 | B2 | 1/2013 | Nagasaka et al. | |
| 8,415,078 | B2 | 4/2013 | Tanaka et al. | |
| 8,465,889 | B2 | 6/2013 | Sekido et al. | |
| 8,524,430 | B2 | 9/2013 | Takagi et al. | |
| 8,546,050 | B2 | 10/2013 | Maruyama et al. | |
| 8,632,931 | B2 | 1/2014 | Sekido et al. | |
| 8,783,209 | B2 | 7/2014 | Kaku et al. | |
| 8,795,936 | B2 | 8/2014 | Sekido et al. | |
| 8,865,382 | B2 | 10/2014 | Nonaka et al. | |
| 9,244,369 | B2 | 1/2016 | Tanaka et al. | |
| 9,316,931 | B2 | 4/2016 | Takagi et al. | |
| 9,389,523 | B2 | 7/2016 | Nakata et al. | |
| 9,594,318 | B2 | 3/2017 | Nakata et al. | |
| 2007/0042281 | A1* | 2/2007 | Orito | G03G 5/0696 430/59.5 |
| 2011/0287353 | A1* | 11/2011 | Horiuchi | C07C 215/74 430/58.35 |
| 2016/0011529 | A1 | 1/2016 | Kosaka et al. | |

FOREIGN PATENT DOCUMENTS

| | | |
|---|---|---|
| JP | 2004-302450 | 10/2004 |
| JP | 2012-014150 | 1/2012 |

* cited by examiner

ELECTROPHOTOGRAPHIC PHOTOSENSITIVE MEMBER, METHOD FOR PRODUCING THE SAME, PROCESS CARTRIDGE AND ELECTROPHOTOGRAPHIC APPARATUS

BACKGROUND OF THE INVENTION

Field of the Invention

The present invention relates to an electrophotographic photosensitive member, a method for producing the same, and a process cartridge and an electrophotographic apparatus including the electrophotographic photosensitive member.

Description of the Related Art

An electrophotographic photosensitive member to be mounted to an electrophotographic apparatus includes an organic electrophotographic photosensitive member (hereinafter, referred to as "electrophotographic photosensitive member") containing an organic photo-conductive material (charge generating material), and such an electrophotographic photosensitive member has been heretofore widely studied. In recent years, the electrophotographic photosensitive member has been demanded to be enhanced in mechanical durability (abrasion resistance) for the purpose of an increase in lifetime and an increase in image quality in repeated use, of the electrophotographic photosensitive member, and many trials have been heretofore made.

For example, Japanese Patent Application Laid-Open No. 2004-302450 and Japanese Patent Application Laid-Open No. 2012-14150 describe an electrophotographic photosensitive member containing, in a surface layer, a copolymerized product of a charge transporting compound having a chain-polymerizable functional group with a polyfunctional acrylate monomer. Such an electrophotographic photosensitive member contains a polyfunctional acrylate monomer in a surface layer to thereby exhibit an excellent abrasion resistance.

SUMMARY OF THE INVENTION

The present inventors, however, have made studies, and have thus found that the electrophotographic photosensitive member containing a polyfunctional acrylate monomer in a surface layer is enhanced in abrasion resistance, but is deteriorated in electrical characteristics, as compared with an electrophotographic photosensitive member containing no polyfunctional acrylate monomer in a surface layer.

One aspect of the present invention is directed to providing an electrophotographic photosensitive member being excellent in abrasion resistance and having good electrical characteristics, and a method for producing the same. Still another aspect of the present invention is directed to providing a process cartridge and an electrophotographic apparatus including the electrophotographic photosensitive member.

According to one aspect of the present invention, there is provided an electrophotographic photosensitive member including a support and a photosensitive layer on the support, wherein a surface layer of the electrophotographic photosensitive member includes a copolymerized product of:

a hole transporting compound having an acryloyloxy group or a methacryloyloxy group and having a triphenylamine backbone and a compound represented by the formula (1) or the formula (2):

(1)

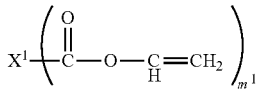

wherein $m^1$ represents an integer of 2 or more and 4 or less, and $X^1$ represents an $m^1$-valent group obtained by removing $m^1$ hydrogen atoms from any of a linear or branched alkane having 2 or more and 18 or less carbon atoms, a cyclic or polycyclic alkane having 6 or more and 12 or less carbon atoms unsubstituted or having a linear or branched alkyl group having 1 or more and 12 or less carbon atoms, and an arene having 6 or more and 12 or less carbon atoms unsubstituted or having a linear or branched alkyl group having 1 or more and 12 or less carbon atoms, provided that the number of carbon atoms in $X^1$ is 2 or more and 18 or less; and (2)

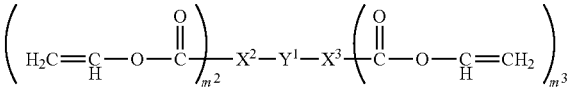

wherein $m^2$ and $m^3$ represent an integer of 1 or more and 2 or less, and $Y^1$ represents an oxygen atom or a sulfur atom, $X^2$ represents an $(m^2+1)$-valent group obtained by removing $(m^2+1)$ hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, and $X^3$ represents an $(m^3+1)$-valent group obtained by removing $(m^3+1)$ hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, provided that the total number of carbon atoms in $X^2$ and $X^3$ is 2 or more and 16 or less.

According to another aspect of the present invention, there is provided a method for producing an electrophotographic photosensitive member including a support and a surface layer on the support, the method including:

preparing a coating liquid for a surface layer, the coating liquid containing a hole transporting compound having an acryloyloxy group or a methacryloyloxy group and having a triphenylamine backbone, and a compound represented by the formula (1) or the formula (2), and forming a coating film of the coating liquid for a surface layer, and curing the coating film to thereby form a surface layer:

(1)

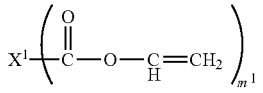

wherein $m^1$ represents an integer of 2 or more and 4 or less, and $X^1$ represents an $m^1$-valent group obtained by removing $m^1$ hydrogen atoms from any of a linear or branched alkane having 2 or more and 18 or less carbon atoms, a cyclic or polycyclic alkane having 6 or more and 12 or less carbon atoms unsubstituted or having a linear or branched alkyl group having 1 or more and 12 or less carbon atoms, and an arene having 6 or more and 12 or less carbon atoms unsubstituted or having a linear or branched alkyl group having 1 or more and 12 or less carbon atoms, provided that the number of carbon atoms in $X^1$ is 2 or more and 18 or less; and (2)

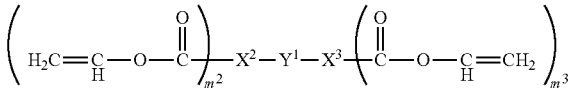

wherein $m^2$ and $m^3$ represent an integer of 1 or more and 2 or less, and $Y^1$ represents an oxygen atom or a sulfur atom, $X^2$ represents an $(m^2+1)$-valent group obtained by removing $(m^2+1)$ hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, and $X^3$ represents an $(m^3+1)$-valent group obtained by removing $(m^3+1)$ hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, provided that the total number of carbon atoms in $X^2$ and $X^3$ is 2 or more and 16 or less.

According to still another aspect of the present invention, there is provided a process cartridge detachably attachable to a main body of an electrophotographic apparatus, integrally supporting the electrophotographic photosensitive member, and at least one unit selected from the group consisting of a charging unit that charges the electrophotographic photosensitive member, a developing unit that develops an electrostatic latent image formed on a surface of the electrophotographic photosensitive member, by a toner, to form a toner image on the surface of the electrophotographic photosensitive member, a transferring unit that transfers the toner image from the surface of the electrophotographic photosensitive member to a transfer material, and a cleaning unit that cleans the surface of the electrophotographic photosensitive member.

According to still another aspect of the present invention, there is provided an electrophotographic apparatus including the electrophotographic photosensitive member, and a charging unit that charges the electrophotographic photosensitive member, an exposure unit that irradiates a surface of the electrophotographic photosensitive member with exposure light to form an electrostatic latent image on the surface of the electrophotographic photosensitive member, a developing unit that develops the electrostatic latent image by a toner to form a toner image on the surface of the electrophotographic photosensitive member, and a transferring unit that transfers the toner image from the surface of the electrophotographic photosensitive member to a transfer material.

Further features of the present invention will become apparent from the following description of exemplary embodiments with reference to the attached drawings.

DESCRIPTION OF THE EMBODIMENTS

Figure 1:
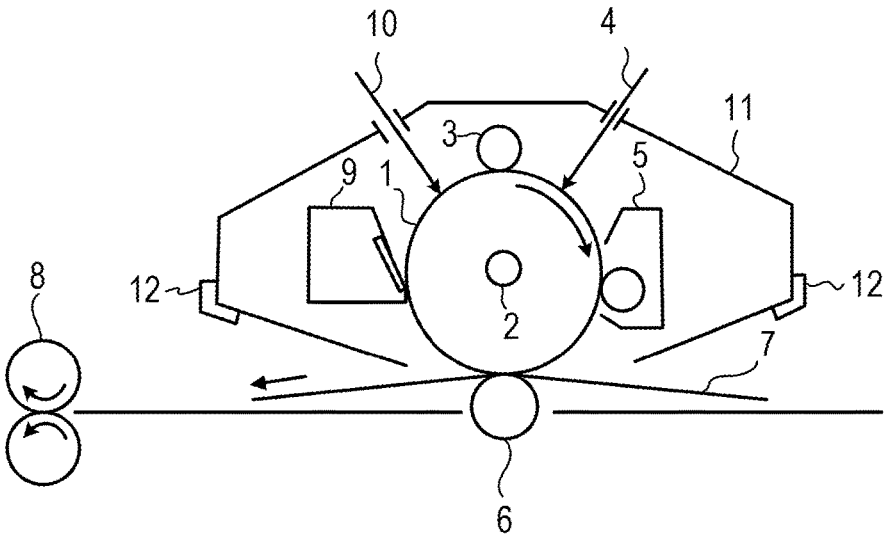
FIG. 1 is a view illustrating one schematic configuration example of an electrophotographic apparatus provided with a process cartridge including an electrophotographic photosensitive member according to one aspect of the present invention.

Preferred embodiments of the present invention will now be described in detail in accordance with the accompanying drawings.

An electrophotographic photosensitive member according to one aspect of the present invention includes a support and a photosensitive layer on the support.

The electrophotographic photosensitive member includes a surface layer containing a copolymerized product of:

(A) a hole transporting compound having an acryloyloxy group or a methacryloyloxy group and having a triphenylamine backbone, and (B) a compound represented by the formula (1) or the formula (2):

(1)

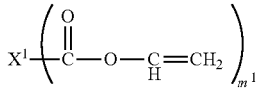

wherein $m^1$ represents an integer of 2 or more and 4 or less, and $X^1$ represents an $m^1$-valent group obtained by removing $m^1$ hydrogen atoms from any of a linear or branched alkane having 2 or more and 18 or less carbon atoms, a cyclic or polycyclic alkane having 6 or more and 12 or less carbon atoms unsubstituted or having a linear or branched alkyl group having 1 or more and 12 or less carbon atoms, and an arene having 6 or more and 12 or less carbon atoms unsubstituted or having a linear or branched alkyl group having 1 or more and 12 or less carbon atoms, provided that the number of carbon atoms in $X^1$ is 2 or more and 18 or less; and (2)

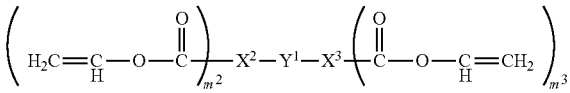

wherein $m^2$ and $m^3$ represent an integer of 1 or more and 2 or less, and $Y^1$ represents an oxygen atom or a sulfur atom, $X^2$ represents an ($m^2$+1)-valent group obtained by removing ($m^2$+1) hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, and $X^3$ represents an ($m^3$+1)-valent group obtained by removing ($m^3$+1) hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, provided that the total number of carbon atoms in $X^2$ and $X^3$ is 2 or more and 16 or less.

The present inventors presume the reason why the effect of the present invention is exerted due to employing of the above configuration, as follows.

A copolymerized product of:

- a hole transporting compound having an acryloyloxy group or a methacryloyloxy group and having a triphenylamine backbone and
- a compound having a polyfunctional chain-polymerizable functional group forms a dense three-dimensional crosslinked structure. Therefore, an electrophotographic photosensitive member including a surface layer containing such a copolymerized product exhibits an excellent abrasion resistance. The chain-polymerizable functional group here means a functional group that can be subjected to chain polymerization. In addition, the chain polymerization, if a production reaction of a polymer compound is generally classified to chain polymerization and sequential polymerization, refers to the former polymerization reaction form. A structure having a vinyl group, or the like, corresponds to the chain-polymerizable functional group, and specific examples thereof include a vinyl group, an acryloyloxy group, a methacryloyloxy group, a vinyl carboxylate group and a styryl group. The compound represented by the formula (1) or the formula (2) has 2 or more and 4 or less vinyl carboxylate groups, and therefore the electrophotographic photosensitive member according to one aspect of the present invention exhibits an excellent abrasion resistance.

In order that the electrophotographic photosensitive member has good electrical characteristics, hole transportation is demanded to smoothly occur in the triphenylamine backbone of the copolymerized product.

When the compound having a polyfunctional chain-polymerizable functional group is a polyfunctional acrylate monomer, a polymerization reaction progresses even between the polyfunctional acrylate monomers to produce a polymerized product of the polyfunctional acrylate monomers. It is considered that such a polymerized product inhibits hole transportation in the triphenylamine backbone to thereby result in deterioration in electrical characteristics.

On the other hand, the compound represented by the formula (1) or the formula (2) has a vinyl carboxylate group, as described above. In general, it is known that, when a compound having a vinyl carboxylate group and a compound having an acryloyloxy group or a methacryloyloxy group are copolymerized, a polymerization reaction hardly occurs between the compounds having a vinyl carboxylate group.

Accordingly, it is considered that the compound represented by the formula (1) or the formula (2) hardly produces a polymerized product thereof by itself not to inhibit hole transportation in the triphenylamine backbone, thereby allowing the electrophotographic photosensitive member according to one aspect of the present invention to exhibit good electrical characteristics.

In the compound represented by the formula (1), $m^1$ represents an integer of 2 or more and 4 or less. If $m^1$ represents 1, the copolymerized product can form no dense three-dimensional crosslinked structure to result in a reduction in abrasion resistance. If $m^1$ represents 5 or more, wrinkles are generated on the surface of the electrophotographic photosensitive member due to rapid cure shrinkage or the like and a normal image cannot be thus obtained. $m^1$ can represent 2 and better electrical characteristics are achieved.

$X^1$ represents an $m^1$-valent group obtained by removing $m^1$ hydrogen atoms from any of a linear or branched alkane having 2 or more and 18 or less carbon atoms, a cyclic or polycyclic alkane having 6 or more and 12 or less carbon atoms unsubstituted or having a linear or branched alkyl group having 1 or more and 12 or less carbon atoms, and an arene having 6 or more and 12 or less carbon atoms unsubstituted or having a linear or branched alkyl group having 1 or more and 12 or less carbon atoms, provided that the number of carbon atoms in $X^1$ is 2 or more and 18 or less. If the number of carbon atoms in $X^1$ is 19 or more, the compound by itself is bulky to inhibit hole transportation in the triphenylamine backbone, thereby resulting in deterioration in electrical characteristics.

$X^1$ preferably represents an $m^1$-valent group obtained by removing $m^1$ hydrogen atoms from any of a linear or branched alkane having 2 or more and 18 or less carbon atoms, and a cyclic or polycyclic alkane having 6 or more and 12 or less carbon atoms unsubstituted or having a linear or branched alkyl group having 1 or more and 12 or less carbon atoms. $X^1$ more preferably represents an $m^1$-valent group obtained by removing $m^1$ hydrogen atoms from a linear or branched alkane having 2 or more and 18 or less carbon atoms, and further preferably represents an $m^1$-valent group obtained by removing $m^1$ hydrogen atoms from a linear or branched alkane having 2 or more and 6 or less carbon atoms. $X^1$ can have such a configuration and therefore better electrical characteristics are achieved.

In the compound represented by the formula (2), $m^2$ and $m^3$ represent an integer of 1 or more and 2 or less. If $m^2$ and $m^3$ represent 3 or more, wrinkles are generated on the surface of the electrophotographic photosensitive member due to rapid cure shrinkage or the like and a normal image cannot be thus obtained. $m^2$ and $m^3$ can represent 1 and therefore better electrical characteristics are achieved.

$X^2$ represents an ($m^2$+1)-valent group obtained by removing ($m^2$+1) hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, and $X^1$ represents an ($m^3$+1)-valent group obtained by removing ($m^3$+1) hydrogen atoms from any of a linear or branched alkane having 1 or more and 15 or less carbon atoms, a cyclic or polycyclic alkane having 6 or more and 12 or less carbon atoms unsubstituted or having a linear or branched alkyl group having 1 or more and 9 or less carbon atoms, and an arene having 6 or more and 12 or less carbon atoms unsubstituted or having a linear or branched alkyl group having 1 or more and 9 or less carbon atoms, provided that the total number of carbon atoms in $X^2$ and $X^3$ is 2 or more and 16 or less. If the total number of carbon atoms in $X^2$ and $X^3$ is 17 or more, the compound by itself is bulky to inhibit hole transportation in the triphenylamine backbone, thereby resulting in deterioration in electrical characteristics.

Preferably, $X^2$ represents an ($m^2$+1)-valent group obtained by removing ($m^2$+1) hydrogen atoms from any of a linear or branched alkane having 1 or more and 15 or less carbon atoms, and a cyclic or polycyclic alkane having 6 or more and 12 or less carbon atoms unsubstituted or having a linear or branched alkyl group having 1 or more and 9 or less carbon atoms, and $X^3$ represents an ($m^3$+1)-valent group obtained by removing ($m^3$+1) hydrogen atoms from any of a linear or branched alkane having 1 or more and 15 or less carbon atoms, and a cyclic or polycyclic alkane having 6 or more and 12 or less carbon atoms unsubstituted or having a linear or branched alkyl group having 1 or more and 9 or less carbon atoms. More preferably, $X^2$ represents an ($m^2$+1)-valent group obtained by removing ($m^2$+1) hydrogen atoms from a linear or branched alkane having 1 or more and 15 or less carbon atoms, and $X^3$ represents an ($m^3$+1)-valent group obtained by removing ($m^3$+1) hydrogen atoms from a linear or branched alkane having 1 or more and 15 or less carbon atoms. Further preferably, $X^2$ represents an ($m^2$+1)-valent group obtained by removing ($m^2$+1) hydrogen atoms from a linear or branched alkane having 1 or more and 3 or less carbon atoms, and $X^1$ represents an ($m^3$+1)-valent group obtained by removing ($m^3$+1) hydrogen atoms from a linear or branched alkane having 1 or more and 3 or less carbon atoms, provided that the total number of carbon atoms in $X^2$ and $X^3$ is 2 or more and 4 or less. $X^2$ and $X^3$ can have such a configuration and therefore better electrical characteristics are achieved.

The compound represented by the formula (1) or the formula (2) can be synthesized by using any synthesis method described in, for example, the following Literatures.

Japanese Patent Application Laid-Open No. 2002-322125

Japanese Patent Application Laid-Open No. H06-135892

Specific examples (exemplary compounds No. 1 to No. 50) of the compound represented by the formula (1) or the formula (2) include the following, but the present invention is not intended to be limited thereto.

Exemplary Compounds No. 1 to No. 50

(No.1)

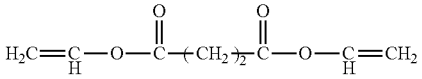

(No.2)

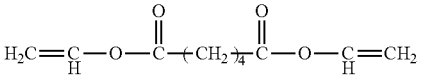

(No.3)

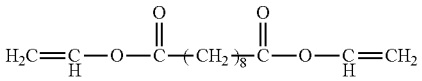

(No.4)

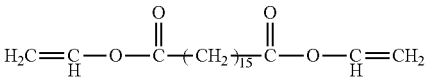

(No.5)

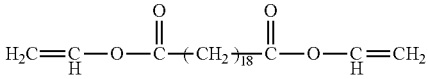

(No.6)

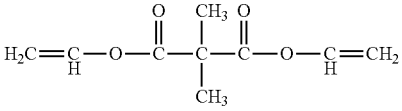

(No.7)

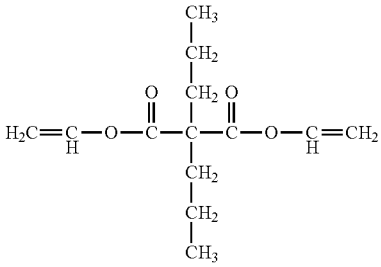

(No.8)

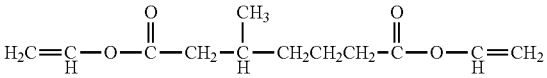

(No.9)

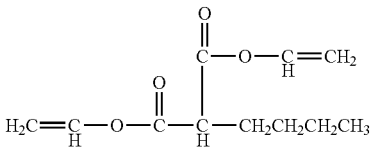

(No.10)

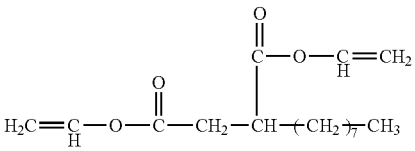

-continued
(No.11)
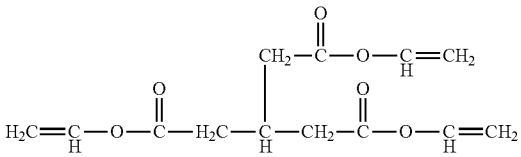
(No.12)
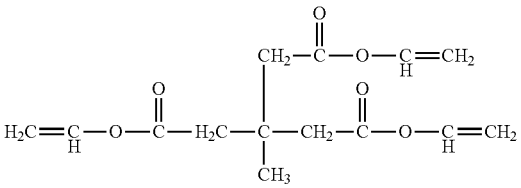
(No.13)
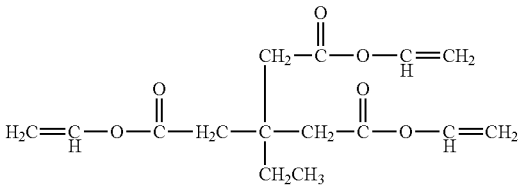
(No.14)
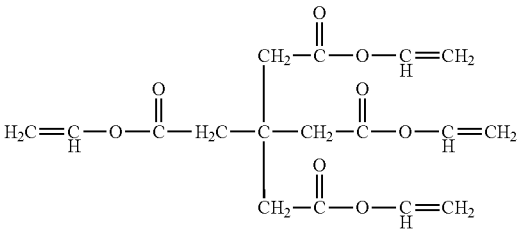
(No.15)
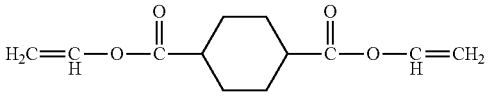
(No.16)
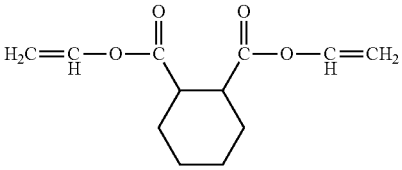
(No.17)
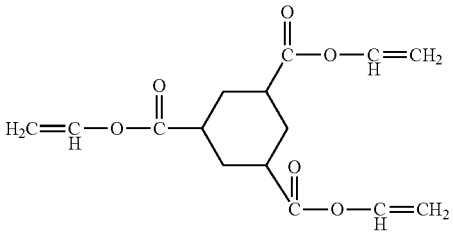
(No.18)
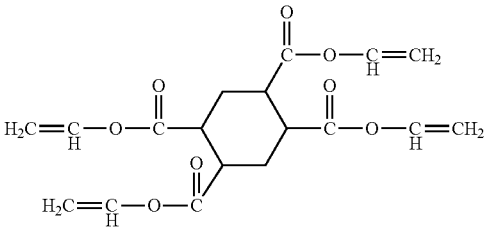
(No.19)
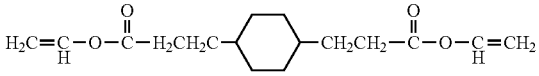
(No.20)
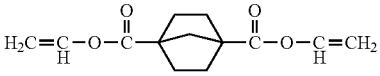
(No.21)
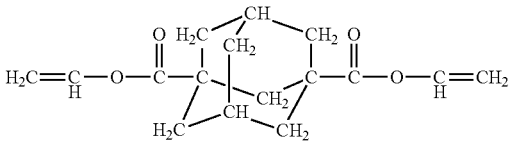
(No.22)
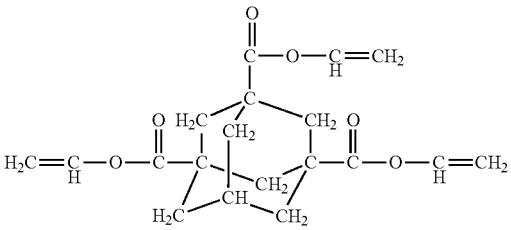
(No.23)
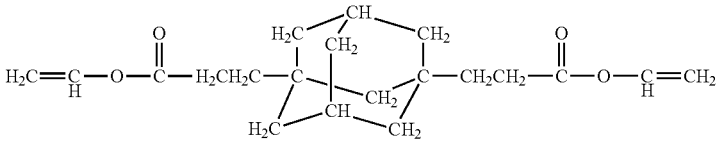
(No.24)
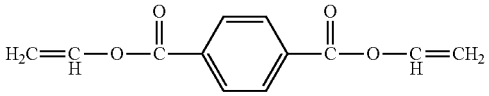
(No.25)
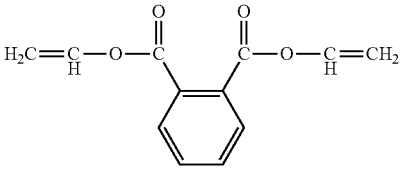

-continued
(No.26)
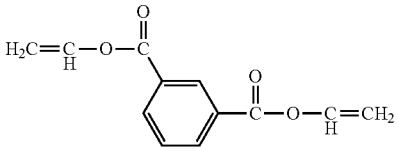
(No.27)
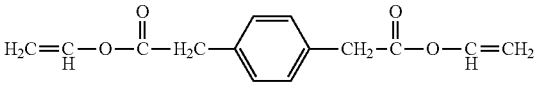
(No.28)
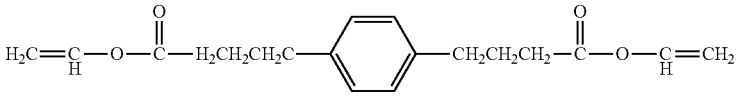
(No.29)
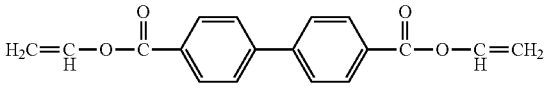
(No.30)
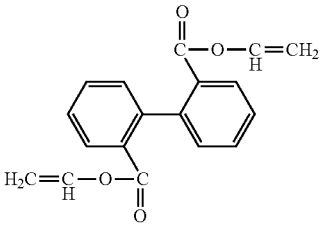
(No.31)
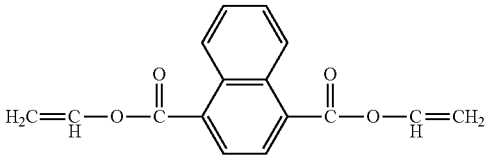
(No.32)
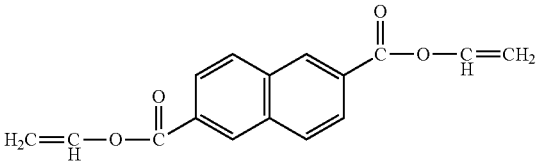
(No.33)
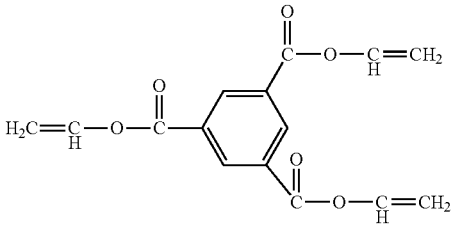
(No.34)
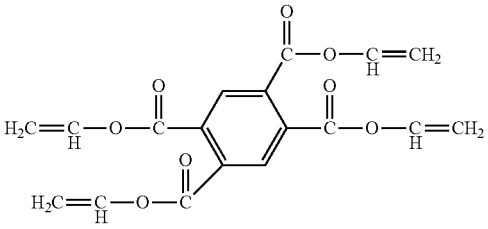
(No.35)
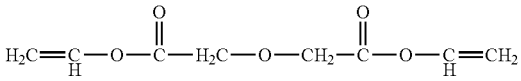
(No.36)
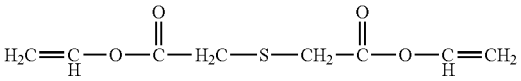
(No.37)
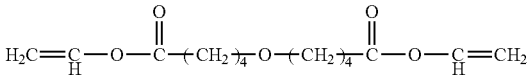
(No.38)
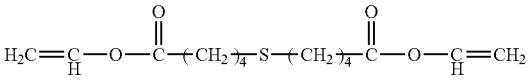
(No.39)
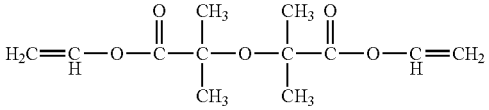
(No.40)
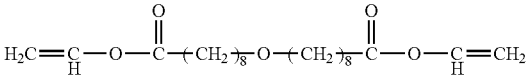
(No.41)
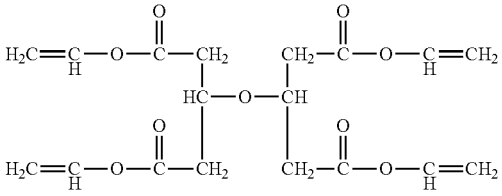
(No.42)
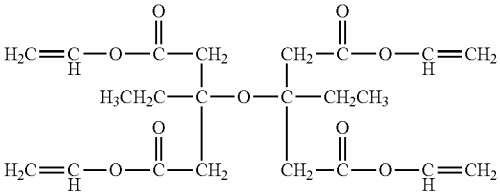

-continued (No.43)

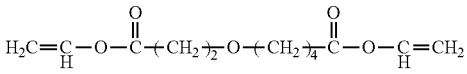

(No.44)

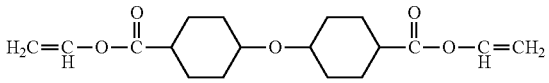

(No.45)

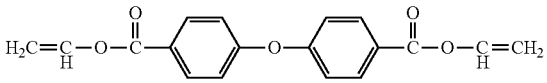

(No.46)

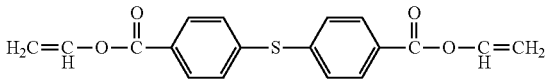

(No.47)

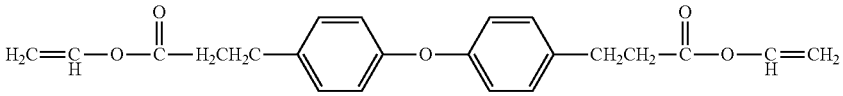

(No.48)

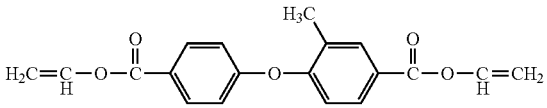

(No.49)

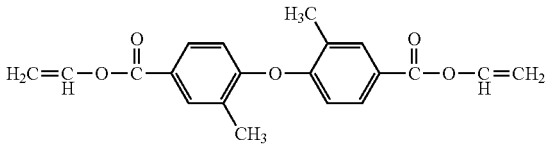

(No.50)

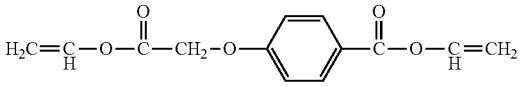

The hole transporting compound having an acryloyloxy group or a methacryloyloxy group and having a triphenylamine backbone can be a compound represented by the formula (3):

$$(P^1)_a Z \tag{3}$$

wherein $P^1$ represents a group represented by the formula (4) or the formula (5); "a" represents an integer of 2 or more and 4 or less, and P's may be the same or different; Z represents a hole transporting group, and a hydrogenated product in which a binding moiety of Z and $P^1$ is replaced with a hydrogen atom is a compound represented by the formula (6) or the formula (7):

(4)

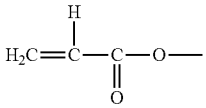

(5)

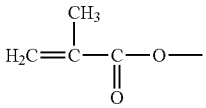

(6)

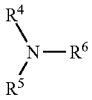

wherein $R^4$, $R^5$ and $R^6$ represent a phenyl group which may have an alkyl group having 1 or more and 6 or less carbon atoms as a substituent; and $R^4$, $R^5$ and $R^6$ may be each the same or different; and (7)

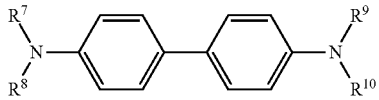

wherein $R^7$, $R^8$, $R^9$ and $R^{10}$ represent a phenyl group which may have an alkyl group having 1 or more and 6 or less carbon atoms as a substituent; and $R^7$, $R^8$, $R^9$ and $R^{10}$ may be each the same or different.

When the compound represented by the formula (3) is used, the surface layer is in a favorably cured state and therefore better abrasion resistance and electrical characteristics are achieved. Specifically, if "a" in the formula (3) represents 1, the surface layer is in a cured state where a dense three-dimensional crosslinked structure is hardly formed, and if "a" represents 5 or more, the surface layer is in a cured state where strain in the surface layer easily occurs due to cure shrinkage or the like.

When the content masses of the hole transporting compound and the compound represented by the formula (1) or the formula (2) contained in the surface layer are designated as Ma and Mb, respectively, $0.05 \leq Mb/(Ma+Mb) \leq 0.50$ can be satisfied. The content masses are in the ranges to thereby provide an electrophotographic photosensitive member being more excellent in durability and having good electrical characteristics.

The surface layer can be formed by forming a coating film of a coating liquid for a surface layer, the coating liquid containing the copolymerized product of the hole transporting compound having an acryloyloxy group or a methacryloyloxy group and having a triphenylamine backbone, and the compound represented by the formula (1) or the formula (2), and curing the coating film.

Various additives can be added to the surface layer. As such an additive, for example, a deterioration preventing agent such as an antioxidant and an ultraviolet absorber, and a lubricant such as a polytetrafluoroethylene (PTFE) particle and carbon fluoride can be used. In addition, a polymerization controlling agent such as a polymerization reaction initiator and a polymerization reaction inhibitor, a leveling agent such as a siloxane-modified acrylic compound and a silicone oil, a surfactant, and the like can also be used. The siloxane-modified acrylic compound is a compound where siloxane as a side chain is introduced to an acrylic polymer, and can be obtained by, for example, copolymerizing an acrylic monomer with siloxane having an acrylic group.

The thickness of the surface layer is preferably 0.1 μm or more and 15 μm or less. Furthermore, the thickness is more preferably 0.5 μm or more and 10 μm or less.

A solvent that does not dissolve any layer provided under the surface layer is preferably used as the solvent for use in preparation of the coating liquid for a surface layer. An alcohol-based solvent such as methanol, ethanol, propanol, isopropanol, 1-butanol, 2-butanol or 1-methoxy-2-propanol is more preferable.

The method for curing the coating film of the coating liquid for a surface layer includes a curing method by heat, ultraviolet light or an electron beam. The coating film can be cured by use of ultraviolet light or an electron beam in order to maintain strength of the surface layer and durability of the electrophotographic photosensitive member.

Polymerization can be performed by use of an electron beam because a very dense (high density) cured product (three-dimensional crosslinked structure) is obtained and a surface layer having higher durability is obtained. In irradiation with an electron beam, examples of an accelerator include scanning type, electrocurtain type, broad beam type, pulse type and laminar type accelerators.

When an electron beam is used, the acceleration voltage of the electron beam can be 120 kV or less from the viewpoint that degradation of material characteristics by the electron beam can be suppressed without any loss of polymerization efficiency. The dose of the electron beam absorbed on the surface of the coating film of the coating liquid for a surface layer is preferably 1 kGy or more and 50 kGy or less, more preferably 5 kGy or more and 10 kGy or less.

When the coating film is cured (subjected to polymerization) by use of an electron beam, the coating film can be irradiated with an electron beam in an inert gas atmosphere and thereafter heated in an inert gas atmosphere in order to suppress the polymerization inhibition action by oxygen. Examples of the inert gas include nitrogen, argon and helium.

The electrophotographic photosensitive member can be irradiated with ultraviolet light or an electron beam and thereafter heated to 100° C. or more and 170° C. or less. Thus, a surface layer having further high durability and suppressing image defects is obtained.

Next, a general configuration of the electrophotographic photosensitive member according to one aspect of the present invention is described. In addition, respective components of the electrophotographic photosensitive member are described and the production methods thereof are also described.

[Electrophotographic Photosensitive Member]

The electrophotographic photosensitive member includes a support and a photosensitive layer on the support. The photosensitive layer includes a monolayer type photosensitive layer containing both a charge generation material and a charge transporting material, and a laminate type photosensitive layer where a charge generation layer containing a charge generation material and a charge transporting layer containing a charge transporting material are separated. In particular, a laminate type photosensitive layer where a charge transporting layer is provided on a charge generation layer can be adopted.

Figure 2:
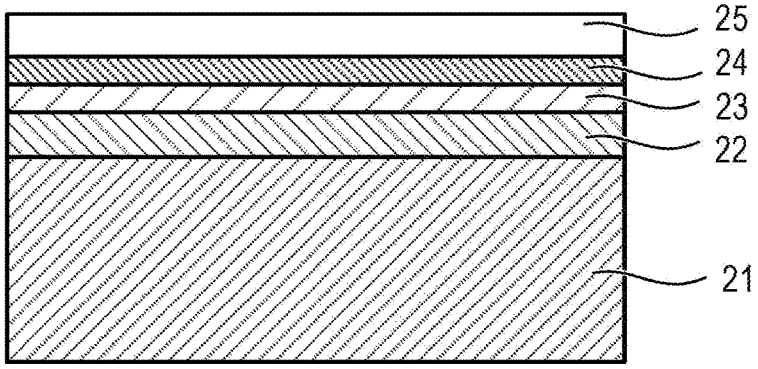
FIG. 2 is a view for describing one layer configuration example of an electrophotographic photosensitive member according to one aspect of the present invention.

FIG. 2 is a view illustrating one layer configuration example of the electrophotographic photosensitive member. In FIG. 2, the electrophotographic photosensitive member includes a support 21, an undercoat layer 22, a charge generation layer 23, a charge transporting layer 24 and a protection layer 25 in the listed order. In such a case, the charge generation layer 23 and the charge transporting layer 24 constitute the photosensitive layer, and the protection layer 25 corresponds to the surface layer. When no protection layer is provided, the charge transporting layer 24 corresponds to the surface layer. The protection layer can be provided on the photosensitive layer to thereby correspond to the surface layer. In particular, a configuration which has a laminate type photosensitive layer including a charge generation layer and a charge transporting layer laminated in the listed order and in which a protection layer is provided on the charge transporting layer can be adopted.

The surface layer contains the copolymerized product of the hole transporting compound having an acryloyloxy group or a methacryloyloxy group and having a triphenylamine backbone, and the compound represented by the formula (1) or the formula (2), as described above. Herein, when the surface layer corresponds to the charge transporting layer, the surface layer further includes a charge transporting material in addition to the copolymerized product.

Hereinafter, the electrophotographic photosensitive member according to one aspect of the present invention is described in more detail, with taking, as an example, an electrophotographic photosensitive member including a protection layer, in which the protection layer corresponds to the surface layer and the photosensitive layer is a laminate type photosensitive layer.

[Support]

The support for use in the electrophotographic photosensitive member can be a support having electro-conductivity (electro-conductive support). Examples thereof include a support made of a metal or an alloy such as iron, copper, gold, silver, aluminum, zinc, titanium, lead, nickel, tin, antimony, indium, chromium, an aluminum alloy and stainless steel. A metallic support or a resin support having a coating formed by vacuum vapor deposition of aluminum, an aluminum alloy, an indium oxide-tin oxide alloy can also be used. For example, a support formed by impregnating a resin with an electro-conductive particle such as carbon black, a tin oxide particle, a titanium oxide particle or a silver particle, or a support containing an electro-conductive resin can also be used. Examples of the shape of the support include a cylindrical shape, a belt shape, a sheet shape or a plate shape, and a cylindrical shape can be adopted.

The surface of the support may be subjected to a cutting treatment, a roughening treatment, an alumite treatment or the like for the purpose of suppression of interference fringes due to scattering of laser light.

[Electro-Conductive Layer]

An electro-conductive layer may also be provided between the support and the photosensitive layer (charge generation layer) or an undercoat layer, for the purposes of suppression of interference fringes due to scattering of laser or the like and coverage of scarring on the support.

The electro-conductive layer can be formed by coating the support with a coating liquid for an electro-conductive layer, the liquid being obtained by a dispersion treatment of an electro-conductive particle together with a binder resin and a solvent, to form a coating film, and drying and/or curing the resulting coating film.

Examples of the electro-conductive particle for use in the electro-conductive layer include carbon black such as acetylene black, a particle of a metal such as aluminum, nickel, iron, nichrome, copper, zinc and silver, and a particle of a metal oxide such as zinc oxide, titanium oxide, tin oxide, antimony oxide, indium oxide, bismuth oxide and ITO (Indium Tin Oxide). Indium oxide doped with tin, or tin oxide doped with antimony or tantalum may also be used.

Examples of the binder resin for use in the electro-conductive layer include a polymer and a copolymer of a vinyl compound such as styrene, vinyl acetate, vinyl chloride, acrylic acid ester, methacrylic acid ester, vinylidene fluoride and trifluoroethylene, and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin and an isocyanate resin.

Examples of the solvent for use in the coating liquid for an electro-conductive layer include an ether-based solvent, an alcohol-based solvent, a ketone-based solvent and an aromatic hydrocarbon solvent.

The thickness of the electro-conductive layer is preferably 0.1 μm or more and 50 μm or less, further more preferably 0.5 μm or more and 40 μm or less, still more preferably 1 μm or more and 30 μm or less.

[Undercoat Layer]

An undercoat layer (intermediate layer) may be provided between the support or the electro-conductive layer and the photosensitive layer (charge generation layer).

The undercoat layer can be formed by coating the support or the electro-conductive layer with a coating liquid for an undercoat layer, the liquid being obtained by dissolution of a binder resin in a solvent, to form a coating film, and drying the resulting coating film.

Examples of the binder resin for use in the undercoat layer include a polyvinyl alcohol resin, a poly-N-vinylimidazole resin, a polyethylene oxide resin, an ethyl cellulose resin, an ethylene-acrylic acid copolymer, a casein resin, a polyamide resin, an N-methoxymethylated 6-nylon resin, a copolymerized nylon resin, a phenol resin, a polyurethane resin, an epoxy resin, an acrylic resin, a melamine resin and a polyester resin.

The undercoat layer may further contain a metal oxide particle. Examples of the metal oxide particle include a particle containing titanium oxide, zinc oxide, tin oxide, zirconium oxide or aluminum oxide. The metal oxide particle may be a metal oxide particle whose surface is treated with a surface treatment agent such as a silane coupling agent.

Examples of the solvent for use in the coating liquid for an undercoat layer include organic solvents such as an alcohol-based solvent, a sulfoxide-based solvent, a ketone-based solvent, an ether-based solvent, an ester-based solvent, an aliphatic halogenated hydrocarbon-based solvent and an aromatic compound.

The thickness of the undercoat layer is preferably 0.05 μm or more and 30 μm or less, more preferably 1 μm or more and 25 μm or less. The undercoat layer may further contain an organic resin fine particle and a leveling agent.

[Photosensitive Layer]

The photosensitive layer is provided on the support, the electro-conductive layer or the undercoat layer.

When a laminate type photosensitive layer is used, a charge generation layer can be formed by coating the support, the electro-conductive layer or the undercoat layer with a coating liquid for a charge generation layer, the liquid being obtained by mixing a charge generation material and a binder resin with a solvent and subjecting the mixture to a dispersion treatment, to form a coating film, and drying the coating film. The charge generation layer may be a vapor-deposited film of the charge generation material.

Examples of the charge generation material for use in the charge generation layer include an azo pigment, a phthalocyanine pigment, an indigo pigment, a perylene pigment, a polycyclic quinone pigment, a squarylium dye, a pyrylium salt, a thiapyrylium salt, a triphenylmethane dye, a quinacridone pigment, an azulenium salt pigment, a cyanine dyestuff, an anthanthrone pigment, a pyranthrone pigment, a xanthene dye, a quinonimine dye and a styryl dye. The charge generation material may be used singly or in combinations of two or more. As the charge generation material, in terms of sensitivity, a phthalocyanine pigment and an azo pigment are preferable, and a phthalocyanine pigment is particularly more preferable.

Among the phthalocyanine pigments, in particular, oxytitanium phthalocyanine, chlorogallium phthalocyanine or hydroxygallium phthalocyanine exhibits an excellent charge generation efficiency. Furthermore, hydroxygallium phthalocyanine can be a hydroxygallium phthalocyanine crystal having strong peaks at Bragg angles 2θ of 7.4°±0.3° and 28.2°±0.3° in CuKα characteristic X-ray diffraction, in terms of sensitivity.

Examples of the binder resin for use in the charge generation layer include a polymer of a vinyl compound such as styrene, vinyl acetate, vinyl chloride, acrylic acid ester, methacrylic acid ester, vinylidene fluoride and trifluoroethylene, and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin and an epoxy resin.

The mass ratio of the charge generation material to the binder resin (charge generation material:binder resin) can be in the range from 1:0.3 to 1:4.

Examples of the dispersion treatment method include a method where a homogenizer, ultrasonic dispersion, a ball mill, a vibration ball mill, a sand mill, an attritor or a roll mill is used.

Examples of the solvent for use in the coating liquid for a charge generation layer include an alcohol-based solvent, a sulfoxide-based solvent, a ketone-based solvent, an ether-based solvent, an ester-based solvent, an aliphatic halogenated hydrocarbon-based solvent and an aromatic compound.

The thickness of the charge generation layer is preferably 0.01 μm or more and 5 μm or less, more preferably 0.1 μm or more and 1 μm or less. Various types of sensitizers, antioxidants, ultraviolet absorbers and plasticizers can also be added to the charge generation layer, if necessary.

Next, the charge transporting layer is described.

The charge transporting layer is formed on the charge generation layer. The charge transporting layer can be formed by coating the charge generation layer with a coating liquid for a charge transporting layer, the liquid being obtained by dissolving a charge transporting material and a binder resin in a solvent, to form a coating film, and drying the resulting coating film.

Examples of the binder resin for use in the charge transporting layer include a polyvinyl butyral resin, a polycarbonate resin, a polyester resin, a phenoxy resin, a polyvinyl acetate resin, an acrylic resin, a polyacrylamide resin, a polyamide resin, a polyvinyl pyridine resin, a cellulose resin, a urethane resin and an epoxy resin. A polycarbonate resin can be adopted.

Examples of the charge transporting material for use in the charge transporting layer include a triarylamine compound, a hydrazone compound, a stilbene compound, a pyrazoline compound, an oxazole compound, a triarylmethane compound and a thiazole compound. The charge transporting material may be used singly or in combinations of two or more.

The ratio of the charge transporting material to the binder resin in the charge transporting layer can be the following: charge transporting material:binder resin=0.3 parts by mass or more and 10 parts by mass or less:1 part by mass.

Examples of the solvent for use in the coating liquid for a charge transporting layer include an alcohol solvent, a sulfoxide solvent, a ketone solvent, an ether solvent, an ester solvent, an aliphatic halogenated hydrocarbon solvent and an aromatic hydrocarbon solvent.

From the viewpoint of suppression of cracking of the charge transporting layer, the drying temperature is preferably 60° C. or more and 150° C. or less, more preferably 80° C. or more and 120° C. or less, and the drying time can be 10 minutes or more and 60 minutes or less.

The thickness of the charge transporting layer is preferably 5 μm to 40 μm, particularly preferably 10 μm to 35 μm. An antioxidant, an ultraviolet absorber, a plasticizer, a metal oxide particle and an inorganic particle can also be added to the charge transporting layer, if necessary. A fluorine atom-containing resin particle, a silicone-containing resin particle and the like may also be contained.

[Protection Layer]

The protection layer corresponding to the surface layer is the above-mentioned surface layer, and can be formed through the following steps.

Step (A): a step of preparing a coating liquid for a surface layer, the coating liquid containing the hole transporting compound having an acryloyloxy group or a methacryloyloxy group and having a triphenylamine backbone, and the compound represented by the formula (1) or the formula (2).

Step (B): a step of forming a coating film of the coating liquid for a surface layer, on the charge transporting layer, and curing the coating film to thereby form a surface layer.

In coating of the coating liquid for each layer, a coating method such as a dip-coating method, a spray coating method, a ring coating method, a spin coating method, a roller coating method, a Meyer bar coating method or a blade coating method can be used.

[Method for Forming Concave Shape Portion on Surface of Electrophotographic Photosensitive Member]

A concave shape portion or a convex shape portion can be provided on the surface layer of the electrophotographic photosensitive member for the purpose of more stabilizing a behavior of a cleaning blade brought into contact with the electrophotographic photosensitive member, during cleaning of the electrophotographic photosensitive member.

The concave shape portion or the convex shape portion may be formed on the whole area or a part of the surface of the electrophotographic photosensitive member. When the concave shape portion or the convex shape portion is formed on a part of the surface of the electrophotographic photosensitive member, the concave shape portion or the convex shape portion can be formed on at least the whole area of a contact region with the cleaning blade.

When the concave shape portion is formed, a mold having a convex shape portion corresponding to a concave shape portion to be formed is contacted under pressure and shape transfer is performed to thereby form the concave shape portion.

Figure 3:
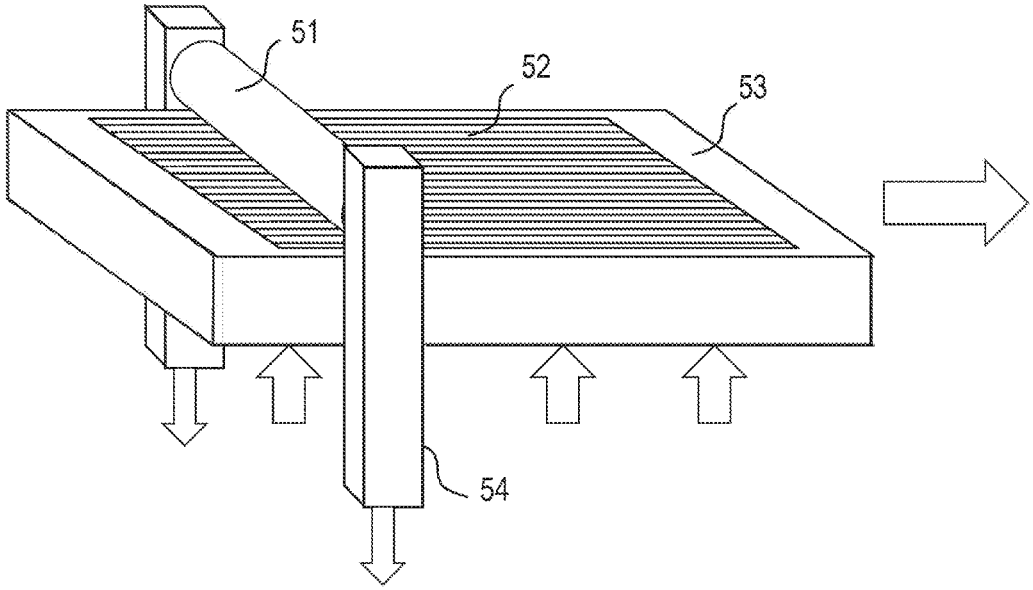
FIG. 3 is a view illustrating an example of a pressure-contact shape transfer/processing apparatus for forming a concave shape portion on the surface of an electrophotographic photosensitive member according to one aspect of the present invention.

FIG. 3 illustrates an example of a pressure-contact shape transfer/processing apparatus for forming the concave shape portion on the surface of the electrophotographic photosensitive member.

The pressure-contact shape transfer/processing apparatus illustrated in FIG. 3, while rotating an electrophotographic photosensitive member 51 as an object to be processed, can continuously bring a mold 52 into contact with the surface (periphery) of the electrophotographic photosensitive member, for pressurizing, thereby forming the concave shape portion and/or a flat portion on the surface of the electrophotographic photosensitive member 51.

Examples of the material of a pressure member 53 include a metal, a metal oxide, plastic and glass. In particular, stainless steel (SUS) can be adopted in terms of mechanical strength, dimension accuracy and durability. The pressure member 53, where the mold 52 is disposed on the upper surface, can bring the mold 52 into contact with the surface of the electrophotographic photosensitive member 51 supported by a support member 54, at a predetermined pressure, by a support member (not illustrated) and a pressure system (not illustrated) disposed on the lower surface of the pressure member 53. The support member 54 may be pushed onto the pressure member 53 at a predetermined pressure, or the support member 54 and the pressure member 53 may be pushed onto each other.

FIG. 3 illustrates an example where the pressure member 53 is moved in a direction perpendicular to the axial direction of the electrophotographic photosensitive member 51, to thereby continuously process the surface of the electrophotographic photosensitive member 51, with the electrophotographic photosensitive member 51 being driven in response to such movement or rotated by driving. Furthermore, the pressure member 53 can be secured and the support member 54 can be moved in the direction perpendicular to the axial direction of the electrophotographic photosensitive member 51, or both the support member 54 and the pressure member 53 can be moved to thereby continuously process the surface of the electrophotographic photosensitive member 51.

The mold 52 and the electrophotographic photosensitive member 51 can be heated from the viewpoint that shape transfer is efficiently performed.

Examples of the mold 52 include one where a metal, a resin film or a silicon wafer finely surface-processed is patterned by a resist, and one where a resin film with a fine particle dispersed therein or a resin film having a fine surface shape is coated with a metal.

An elastic member can be disposed between the mold 52 and the pressure member 53 from the viewpoint that the pressure for pushing onto the electrophotographic photosensitive member 51 is made uniform.

[Configurations of Process Cartridge and Electrophotographic Apparatus]

A process cartridge according to one aspect of the present invention detachably attachable to the main body of an electrophotographic apparatus, integrally supporting the electrophotographic photosensitive member, and at least one unit selected from the group consisting of a charging unit that charges the electrophotographic photosensitive member, a developing unit that develops an electrostatic latent image formed on the surface of the electrophotographic photosensitive member, by a toner, to form a toner image on the surface of the electrophotographic photosensitive member, a transferring unit that transfers the toner image from the surface of the electrophotographic photosensitive member to a transfer material, and a cleaning unit that cleans the surface of the electrophotographic photosensitive member.

An electrophotographic apparatus according to one aspect of the present invention includes the above-mentioned electrophotographic photosensitive member, and a charging unit that charges the electrophotographic photosensitive member, an exposure unit that irradiates the surface of the electrophotographic photosensitive member with exposure light to form an electrostatic latent image on the surface of the electrophotographic photosensitive member, a developing unit that develops the electrostatic latent image by a toner to form a toner image on the surface of the electrophotographic photosensitive member, and a transferring unit that transfers the toner image from the surface of the electrophotographic photosensitive member to a transfer material.

Next, FIG. 1 illustrates one schematic configuration example of an electrophotographic apparatus provided with a process cartridge including an electrophotographic photosensitive member.

In FIG. 1, a cylinder-shaped electrophotographic photosensitive member 1 is rotary-driven around a shaft 2 in an arrow direction at a predetermined peripheral velocity. The surface (periphery) of the electrophotographic photosensitive member 1 is positively or negatively charged by a charging unit (primary charging unit) 3 during rotation. Next, the surface of the electrophotographic photosensitive member 1 is irradiated with exposure light (image exposure light) 4 emitted from an exposure unit (image exposure unit) (not illustrated). The intensity of the exposure light 4 is modulated according to a time-series electrical digital image signal of objective image information. Examples of the exposure unit include slit exposure and laser beam scanning exposure units. Thus, an electrostatic latent image is formed on the surface of the electrophotographic photosensitive member 1 according to objective image information.

The electrostatic latent image formed on the surface of the electrophotographic photosensitive member 1 is then developed (regular development or inversion development) by a toner received in a developing unit 5, to form a toner image. The toner image formed on the surface of the electrophotographic photosensitive member 1 is transferred to a transfer material 7 by a transferring unit 6. When the transfer material 7 is here paper, the transfer material 7 is taken out from a paper-feeding unit (not illustrated), in synchronization with rotation of the electrophotographic photosensitive member 1, and fed in between the electrophotographic photosensitive member 1 and the transferring unit 6. A bias voltage having a polarity opposite to the charge retained in the toner is applied from a bias power source (not illustrated) to the transferring unit 6. The transferring unit may be an intermediate transfer-type transferring unit having a primary transfer member, an intermediate transfer member and a secondary transfer member.

The transfer material 7 to which the toner image is transferred is separated from the surface of the electrophotographic photosensitive member 1, conveyed to a fixing unit 8, subjected to a fixing treatment of the toner image, and thus discharged as an image formed material (print, copy) outside the electrophotographic apparatus.

The surface of the electrophotographic photosensitive member 1 after transferring of the toner image is cleaned by a cleaning unit 9, and an attached object such as a transfer residual toner is removed. The transfer residual toner can also be recovered by the developing unit or the like. Furthermore, the surface of the electrophotographic photosensitive member 1 is, if necessary, subjected to a neutralization treatment by irradiation with pre-exposure light 10 from a pre-exposure unit (not illustrated), and thereafter repeatedly used for image forming. When the charging unit 3 is a contact charging unit using a charging roller or the like, the pre-exposure unit is not necessarily required.

A process cartridge according to one aspect of the present invention is obtained by selecting a plurality of components including the electrophotographic photosensitive member 1, from constitutive components such as the electrophotographic photosensitive member 1, the charging unit 3, the developing unit 5, the transferring unit 6 and the cleaning unit 9, accommodating such components in a container, and integrally supporting such components to form a process cartridge. The process cartridge may be configured to be detachably attachable to the main body of an electrophotographic apparatus such as a copier or a laser beam printer. In FIG. 1, a cartridge integrally supports the electrophotographic photosensitive member 1, and the charging unit 3, the developing unit 5 and the cleaning unit 9. The cartridge then serves as a process cartridge 11 detachably attachable to the main body of an electrophotographic apparatus by use of a guiding unit 12 such as a rail in the main body of an electrophotographic apparatus.

One aspect of the present invention can provide an electrophotographic photosensitive member being excellent in abrasion resistance and having good electrical characteristics, and a method for producing the same. Another aspect of the present invention can provide a process cartridge and an electrophotographic apparatus including the electrophotographic photosensitive member.

EXAMPLES

Hereinafter, the present invention is described in more detail with respect to specific Examples. Herein, "part(s)" in Examples means "part(s) by mass".

Example 1

An aluminum cylinder having a diameter of 30 mm, a length of 357.5 mm and a thickness of 1 mm was prepared as a support (cylinder-shaped electro-conductive support).

Next, 100 parts of a zinc oxide particle (specific surface area: 19 $m^2/g$, powder resistivity: $4.7\times10^6$ Ω·cm) and 500 parts of toluene were stirred and mixed, and 0.8 parts of a silane coupling agent was added thereto and stirred for 6 hours. Thereafter, toluene was distilled off under reduced pressure, and the resultant was heated and dried at 130° C. for 6 hours to provide a surface-treated zinc oxide particle. KBM-602 (compound name: N-2-(aminoethyl)-3-aminopropylmethyldimethoxysilane) produced by Shin-Etsu Chemical Co., Ltd. was used as the silane coupling agent.

Next, 15 parts of a polyvinyl butyral resin (weight average molecular weight: 40000, trade name: BM-1, produced by Sekisui Chemical Co., Ltd.) as a polyol resin and 15 parts of blocked isocyanate (trade name: Sumidur 3175, produced by Sumika Covestro Urethane Co., Ltd. (former name: Sumika Bayer Urethane Co., Ltd.)) were dissolved in a mixed solution of 73.5 parts of methyl ethyl ketone and 73.5 parts of 1-butanol. The surface-treated zinc oxide particle (80.8 parts) and 0.8 parts of 2,3,4-trihydroxybenzophenone (produced by Tokyo Chemical Industry Co., Ltd.) were added to the solution, and dispersed by a sand mill apparatus using glass beads of 0.8 mm in diameter, under an atmosphere at 23±3° C. for 3 hours. After the dispersing, 0.01 parts of silicone oil (trade name: SH28PA, produced by Dow Corning Toray Co., Ltd.) and 5.6 parts of a crosslinked polymethylmethacrylate (PMMA) particle (trade name: TECHPOLYMER SSX-103, produced by Sekisui Plastic Co., Ltd., average primary particle size: 3 μm) were added and stirred to prepare a coating liquid for an undercoat layer.

The aluminum cylinder was dip-coated with the coating liquid for an undercoat layer to form a coating film, and the resulting coating film was dried at 160° C. for 40 minutes to form an undercoat layer having a thickness of 18 μm.

Next, a hydroxygallium phthalocyanine crystal of a crystal form having strong peaks at Bragg angles 2θ±0.2° of 7.4° and 28.2° in CuKα characteristic X-ray diffraction was prepared. Twenty parts of the hydroxygallium phthalocyanine crystal, 0.2 parts of a compound represented by the following formula (A), 10 parts of a polyvinyl butyral resin (trade name: S-Lec BX-1, produced by Sekisui Chemical Co., Ltd.) and 600 parts of cyclohexanone were dispersed by a sand mill apparatus using glass beads of 1 mm in diameter, for 4 hours. Thereafter, 700 parts of ethyl acetate was added to prepare a coating liquid for a charge generation layer. The undercoat layer was dip-coated with the coating liquid for a charge generation layer to form a coating film, and the resulting coating film was heated and dried in an oven at a temperature of 80° C. for 15 minutes to thereby form a charge generation layer having a thickness of 0.17 μm.

(A)

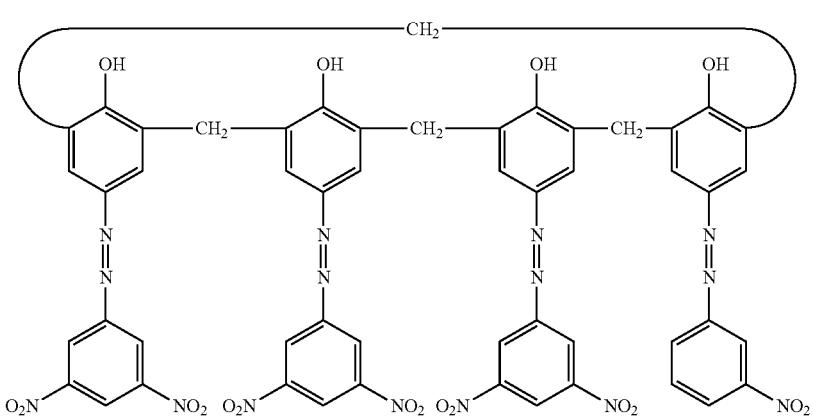

Next, 30 parts of a compound (charge transporting material) represented by the following formula (B), 60 parts of a compound (charge transporting material) represented by the following formula (C), 10 parts of a compound represented by the following formula (D), 100 parts of a polycarbonate resin (trade name: Iupilon Z400, produced by Mitsubishi Engineering-Plastics Corporation, bisphenol Z type) and 0.02 parts of polycarbonate (viscosity average molecular weight Mv: 20000) having a structural unit represented by the following formula (E) were dissolved in a solvent of 600 parts of mixed xylene and 200 parts of dimethoxymethane to thereby prepare a coating liquid for a charge transporting layer. The charge generation layer was dip-coated with the coating liquid for a charge transporting layer to form a coating film, and the resulting coating film was dried at 100° C. for 30 minutes to thereby form a charge transporting layer having a thickness of 18 μm.

(B)

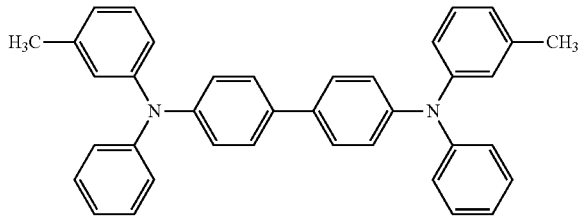

(C)

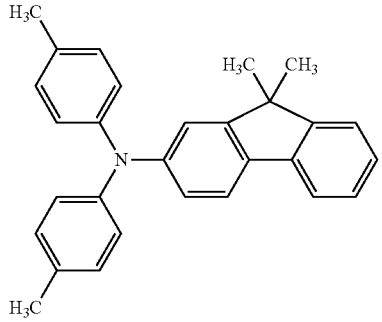

-continued (D)

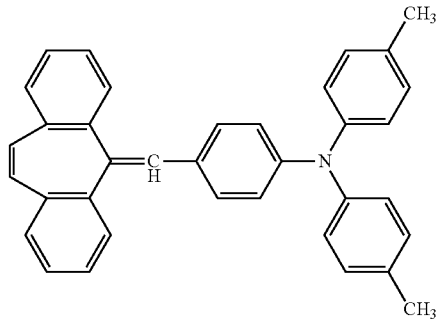

-continued (E)

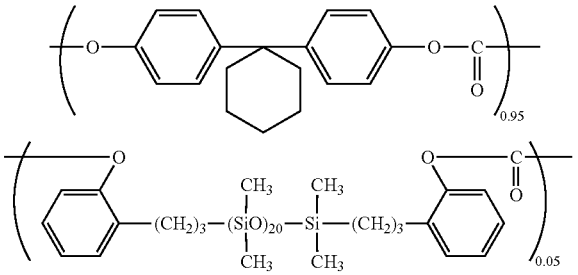

(in the formula (E), 0.95 and 0.05 mean the molar ratio between two structural units (copolymerization ratio).)

Next, 21 parts of exemplary compound (No. 2), 49 parts of a hole transporting compound represented by the following formula (F), 30 parts of a polytetrafluoroethylene particle (Ruburon L-2, produced by Daikin Industries, Ltd.), 0.9 parts of a fluorine-containing resin (trade name: GF300, produced by Toagosei Co., Ltd.), 100 parts of 1-propanol and 100 parts of 1,1,2,2,3,3,4-heptafluorocyclopentane (trade name: Zeorora H, produced by Zeon Corporation) were mixed, and thereafter the solution was subjected to a dispersion treatment by a super high speed disperser. Thereafter, the solution was filtered by a polyflon filter (trade name: PF-060, manufactured by Toyo Roshi Kaisha, Ltd.) to thereby prepare a coating liquid for a surface layer.

(F)

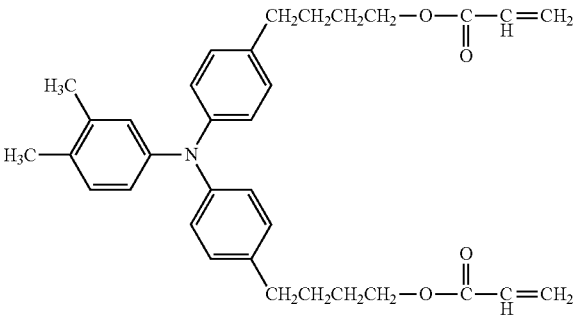

The charge transporting layer was dip-coated with the coating liquid for a surface layer to form a coating film, and the resulting coating film was dried at 50° C. for 5 minutes. Thereafter, while a support (object to be irradiated) was rotated under a nitrogen atmosphere at a speed of 200 rpm, the coating film was irradiated with an electron beam in conditions of an acceleration voltage of 70 kV and a beam current of 5.0 mA for 1.6 seconds. The dose of the electron beam absorbed was here measured and found to be 15 kGy. Thereafter, the temperature of the coating film was raised from 25° C. to 140° C. under a nitrogen atmosphere over 15 seconds to perform heating of the coating film. The oxygen concentration from the irradiation with an electron beam to the subsequent heating treatment was 16 ppm or less. Next, the coating film was naturally cooled in the air until the temperature thereof was decreased to 25° C., and thereafter subjected to a heating treatment at 105° C. for 15 minutes to form a surface layer (protection layer) having a thickness of 5 μm.

Thus, an electrophotographic photosensitive member having the protection layer, before concave portion formation, was produced.

Next, a mold member (mold) was placed in a pressure-contact shape transfer/processing apparatus, and the produced electrophotographic photosensitive member before concave portion formation was surface-processed.

Figure 4A:
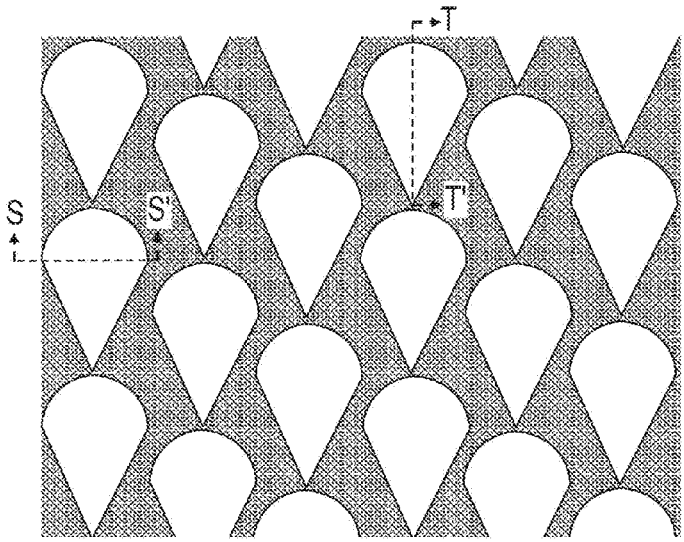
FIG. 4A is a top view illustrating a mold used in Examples and Comparative Examples.
Figure 4B:
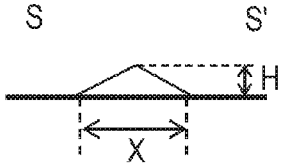
FIG. 4B is a cross-sectional view along S-S' in FIG. 4A.
Figure 4C:
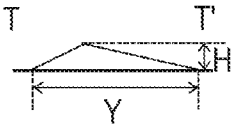
FIG. 4C is a cross-sectional view along T-T' in FIG. 4A.

Specifically, a mold illustrated in FIGS. 4A to 4C was placed in a pressure-contact shape transfer/processing apparatus generally having a configuration illustrated in FIG. 3, and the produced electrophotographic photosensitive member before concave portion formation was surface-processed. FIGS. 4A to 4C are views illustrating a mold used in Examples and Comparative Examples, FIG. 4A is a top view schematically illustrating the mold, FIG. 4B is a schematic cross-sectional view (cross-sectional view of the S-S' cross-section in FIG. 4A) of the convex portion of the mold in the axial direction of the electrophotographic photosensitive member, and FIG. 4C is a cross-sectional view (cross-sectional view of the T-T' cross-section in FIG. 4A) of the convex portion of the mold in the circumferential direction of the electrophotographic photosensitive member. The mold illustrated in FIGS. 4A to 4C has a convex shape having a maximum width (maximum width in the axial direction of the electrophotographic photosensitive member when the convex portion on the mold is viewed from above) X of 50 μm, a maximum length (maximum length in the circumferential direction of the electrophotographic photosensitive member when the convex portion on the mold is viewed from above) Y of 75 μm, an area rate of 56% and a height H of 4 μm. The area rate here means the area rate of the convex portion in the entire surface when the mold is viewed from above. In processing, while the temperatures of the electrophotographic photosensitive member and the mold were controlled so that the temperature of the surface of the electrophotographic photosensitive member was 120° C., and the electrophotographic photosensitive member and a pressure member were pushed onto the mold at a pressure of 7.0 MPa, the electrophotographic photosensitive member was rotated in the circumferential direction to form a concave shape portion on the entire surface (periphery) of the surface layer of the electrophotographic photosensitive member. Thus, the electrophotographic photosensitive member was produced.

The surface of the resulting electrophotographic photosensitive member was magnified and observed by a laser microscope (manufactured by Keyence Corporation, trade name: X-100) with a 50-magnification lens, and the concave shape portion provided on the surface of the electrophotographic photosensitive member was observed. In such observation, adjustment was conducted so that no tilt in the longitudinal direction (axial direction) of the electrophotographic photosensitive member was made and focusing on the vertex of the circular arc of the electrophotographic photosensitive member was made in the circumferential direction. The image magnified and observed was connected by an image connection application to provide a square region 500 μm on a side. With respect to the results obtained, the height data, image-processed, was selected by the accompanying image analysis software and subjected to filter processing by a filter type median.

As a result of the observation, the depth of the concave shape portion was 2 μm, the width of the opening in the axial direction was 50 μm, the length of the opening in the circumferential direction was 75 μm, and the area was 140000 $\mu m^2$. The area here corresponds to the area of the concave shape portion when the surface of the electrophotographic photosensitive member is viewed from above, and means the area of the opening of the concave shape portion.

The resulting electrophotographic photosensitive member was mounted to the cyan station of an altered machine of an electrophotographic apparatus (copier) (trade name: iR-ADV C5051) manufactured by Canon Inc., as an evaluation apparatus, and subjected to a paper-feeding endurance test in an environment of 23° C. and 50% RH for 100000 sheets with the dark portion potential and the light portion potential being set at −700 V and −200 V, respectively, and the abrasion loss (μm) of the electrophotographic photosensitive member surface after paper-feeding was confirmed. When the abrasion loss was here less than 30 μm, abrasion resistance of the electrophotographic photosensitive member was determined to be enhanced.

Image formation was separately performed in the same conditions continuously for 1000 sheets and the potential variation of the electrophotographic photosensitive member was examined. The value "Potential after 1000 sheets−Initial potential" of an image exposure region VL was calculated as ΔVL. When the ΔVL was here less than 20 V, the electrophotographic photosensitive member was determined to have no problems about electrical characteristics.

Example 2

An electrophotographic photosensitive member was produced in the same manner as in Example 1 except that the hole transporting compound represented by the formula (F) was changed to a hole transporting compound represented by the following formula (G), and the evaluation was performed.

(G)

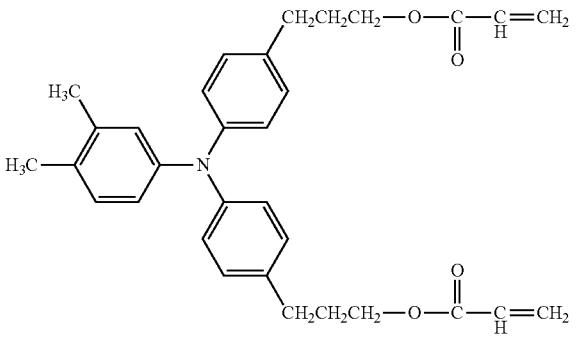

Example 3

An electrophotographic photosensitive member was produced in the same manner as in Example 1 except that the hole transporting compound represented by the formula (F) was changed to a hole transporting compound represented by the following formula (H), and the evaluation was performed.

(H)

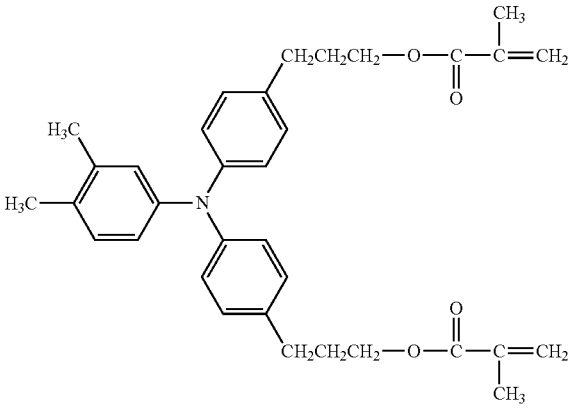

Examples 4 to 11

Respective electrophotographic photosensitive members were produced in the same manner as in Example 2 except that exemplary compound (No. 2) was sequentially changed to exemplary compounds (No. 35), (No. 3), (No. 5), (No. 15), (No. 21), (No. 24), (No. 45) and (No. 13), and the evaluations were performed.

Example 12

An electrophotographic photosensitive member was produced in the same manner as in Example 1 except that 21 parts of exemplary compound (No. 2) was changed to 35 parts of exemplary compound (No. 13) and 49 parts of the hole transporting compound represented by the formula (F) was changed to 35 parts of a hole transporting compound represented by the following formula (I) in the coating liquid for a surface layer in Example 1, and the evaluation was performed.

(I)

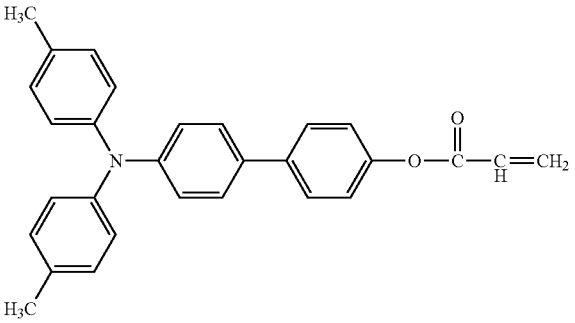

Example 13

An electrophotographic photosensitive member was produced in the same manner as in Example 2 except that the amount of exemplary compound (No. 2) was changed to 3.5 parts and the amount of the hole transporting compound represented by the formula (G) was changed to 66.5 parts in the coating liquid for a surface layer in Example 2, and the evaluation was performed.

Example 14

An electrophotographic photosensitive member was produced in the same manner as in Example 2 except that the amount of exemplary compound (No. 2) was changed to 2 parts and the amount of the hole transporting compound represented by the formula (G) was changed to 68 parts in the coating liquid for a surface layer in Example 2, and the evaluation was performed.

Example 15

An electrophotographic photosensitive member was produced in the same manner as in Example 2 except that the amount of exemplary compound (No. 2) was changed to 42 parts and the amount of the hole transporting compound represented by the formula (G) was changed to 28 parts in the coating liquid for a surface layer in Example 2, and the evaluation was performed.

Comparative Example 1

An electrophotographic photosensitive member was produced in the same manner as in Example 1 except that exemplary compound (No. 2) was not used and the amount of the hole transporting compound represented by the formula (F) was changed to 70 parts in the coating liquid for a surface layer in Example 1, and the evaluation was performed.

Comparative Example 2

An electrophotographic photosensitive member was produced in the same manner as in Example 1 except that exemplary compound (No. 2) was changed to a compound represented by the following formula (C-1) in the coating liquid for a surface layer in Example 1, and the evaluation was performed.

(C-1)

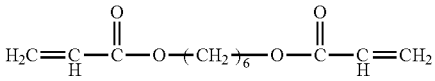

Comparative Example 3

An electrophotographic photosensitive member was produced in the same manner as in Example 1 except that exemplary compound (No. 2) was changed to a compound represented by the following formula (C-2) in the coating liquid for a surface layer in Example 1, and the evaluation was performed.

(C-2)

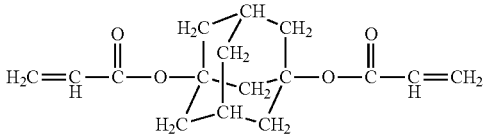

Comparative Example 4

An electrophotographic photosensitive member was produced in the same manner as in Example 12 except that exemplary compound (No. 13) was changed to a compound represented by the following formula (C-3) in the coating liquid for a surface layer in Example 12, and the evaluation was performed.

(C-3)

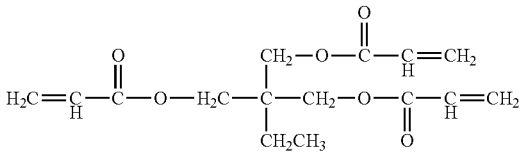

Comparative Example 5

An electrophotographic photosensitive member was produced in the same manner as in Example 1 except that exemplary compound (No. 2) was changed to a compound represented by the following formula (C-4) in the coating liquid for a surface layer in Example 1, and the evaluation was performed.

(C-4)

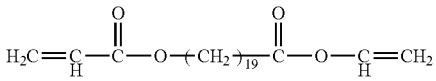

The evaluation results of each Example and each Comparative Example are shown in Table 1.

TABLE 1

| | Compound represented by formula (1) or formula (2) | | Hole transporting compound | (Mb/(Ma + Mb)) | Abrasion loss after paper-feeding for 100000 sheets (μm) | ΔVL after paper-feeding for 1000 sheets (V) |
|---|---|---|---|---|---|---|
| | Compound No. | Structural formula | | | | |
| Example 1 | No. 2 | 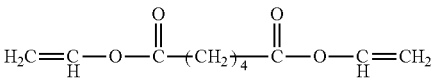 | (F) | 0.30 | 0.22 | 10 |

TABLE 1-continued
| | Compound represented by formula (1) or formula (2) | | Hole transporting compound | (Mb/(Ma + Mb)) | Abrasion loss after paper-feeding for 100000 sheets (μm) | ΔVL after paper-feeding for 1000 sheets (V) |
|---|---|---|---|---|---|---|
| | Compound No. | Structural formula | | | | |
| Example 2 | No. 2 | 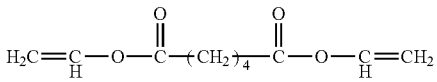 | (G) | 0.30 | 0.16 | 8 |
| Example 3 | No. 2 | 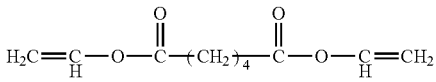 | (H) | 0.30 | 0.17 | 9 |
| Example 4 | No. 35 | 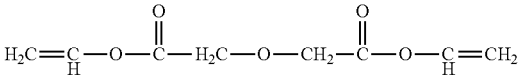 | (G) | 0.30 | 0.20 | 8 |
| Example 5 | No. 3 | 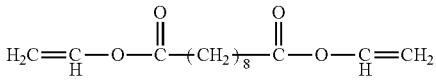 | (G) | 0.30 | 0.24 | 10 |
| Example 6 | No. 5 | 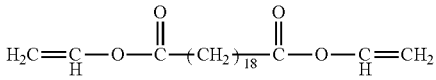 | (G) | 0.30 | 0.26 | 12 |
| Example 7 | No. 15 | 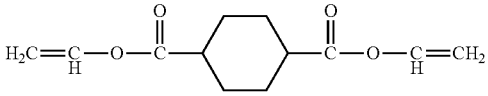 | (G) | 0.30 | 0.20 | 11 |
| Example 8 | No. 21 | 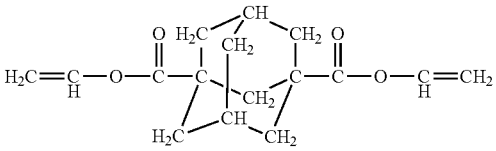 | (G) | 0.30 | 0.18 | 10 |
| Example 9 | No. 24 | 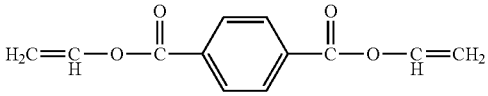 | (G) | 0.30 | 0.24 | 11 |
| Example 10 | No. 45 | 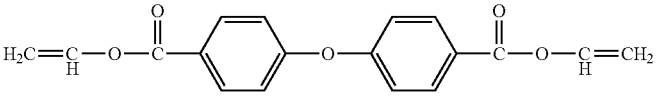 | (G) | 0.30 | 0.22 | 11 |
| Example 11 | No. 13 | 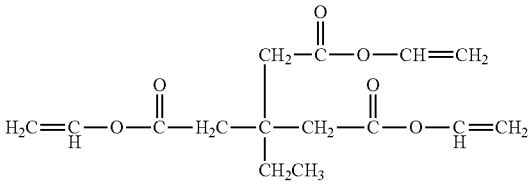 | (G) | 0.30 | 0.13 | 10 |
| Example 12 | No. 13 | 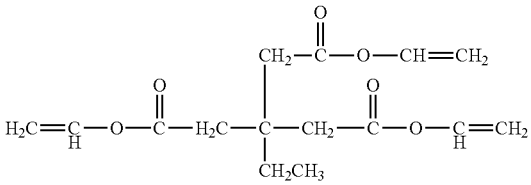 | (I) | 0.50 | 0.26 | 12 |

TABLE 1-continued

| | Compound represented by formula (1) or formula (2) | | Hole transporting compound | (Mb/(Ma + Mb)) | Abrasion loss after paper-feeding for 100000 sheets (μm) | ΔVL after paper-feeding for 1000 sheets (V) |
|---|---|---|---|---|---|---|
| | Compound No. | Structural formula | | | | |
| Example 13 | No. 2 | 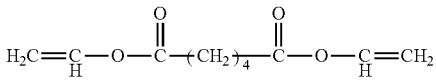 | (G) | 0.05 | 0.21 | 9 |
| Example 14 | No. 2 | 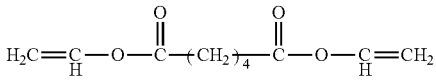 | (G) | 0.03 | 0.29 | 9 |
| Example 15 | No. 2 | 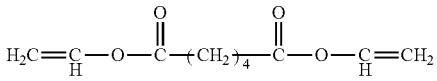 | (G) | 0.60 | 0.11 | 13 |
| Comparative Example 1 | None | — | (F) | 0.00 | 0.44 | 9 |
| Comparative Example 2 | C-1 | 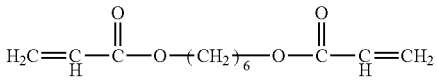 | (F) | 0.30 | 0.18 | 26 |
| Comparative Example 3 | C-2 | 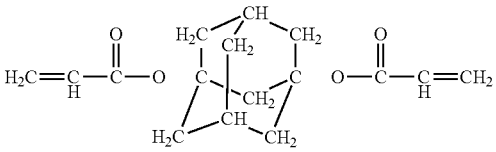 | (F) | 0.30 | 0.17 | 30 |
| Comparative Example 4 | C-3 | 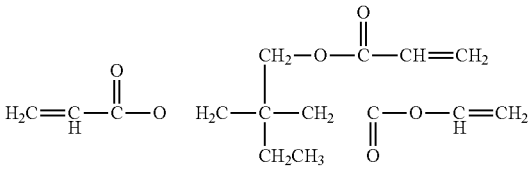 | (I) | 0.50 | 0.26 | 27 |
| Comparative Example 5 | C-4 | 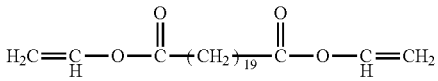 | (F) | 0.30 | 0.25 | 22 |

As a result of the evaluations, in each Example, abrasion resistance of the electrophotographic photosensitive member surface after paper-feeding for 100000 sheets was enhanced and also the potential variation after paper-feeding for 1000 sheets had no problem.

As a result of the evaluations, in Comparative Example 1, in particular, the abrasion loss on the electrophotographic photosensitive member surface after paper-feeding for 100000 sheets was large and abrasion resistance was poor. In Comparative Examples 2, 3, 4 and 5, in particular, the potential variation after paper-feeding for 1000 sheets was increased and deterioration in electrical characteristics was observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-081295, filed Apr. 14, 2016, which is hereby incorporated by reference herein in its entirety.

What is claimed is:

1. An electrophotographic photosensitive member comprising:

a support; and a photosensitive layer on the support, wherein a surface layer of the electrophotographic photosensitive member comprises a copolymerized product of a hole transporting compound having an acryloyloxy group or a methacryloyloxy group and having a triphenylamine backbone, and a compound represented by formula (1) or formula (2):

(1)

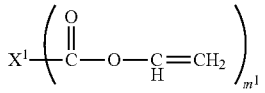

where $m^1$ represents 2 and $X^1$ represents a 2-valent group obtained by removing 2 hydrogen atoms from any of a linear or branched alkane having 2 to 18 carbon atoms, a cyclic or polycyclic alkane having 6 to 12 carbon atoms unsubstituted or having a linear or branched alkyl group having 1 to 12 carbon atoms, and an arene having 6 to 12 carbon atoms unsubstituted or having a linear or branched alkyl group having 1 to 12 carbon atoms, provided that the number of carbon atoms in $X^1$ is 2 to 18; and (2)

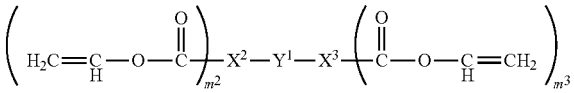

where $m^2$ represents 1, $m^3$ represents 1, and $Y^1$ represents an oxygen atom or a sulfur atom, $X^2$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, and $X^3$ represents a 2-valent group obtained by removing 2 hydrogen atoms from any of a linear or branched alkane having 1 to 15 carbon atoms, a cyclic or polycyclic alkane having 6 to 12 carbon atoms, unsubstituted or having a linear or branched alkyl group having 1 to 9 carbon atoms, and an arene having 6 to 12 carbon atoms, unsubstituted or having a linear or branched alkyl group having 1 to 9 carbon atoms, provided that the total number of carbon atoms in $X^2$ and $X^3$ is 2 to 16.

2. The electrophotographic photosensitive member according to claim 1, wherein $X^1$ represents a 2-valent group obtained by removing 2 hydrogen atoms from any of a linear or branched alkane having 2 to 18 carbon atoms, and a cyclic or polycyclic alkane having 6 to 12 carbon atoms unsubstituted or having a linear or branched alkyl group having 1 to 12 carbon atoms, $X^2$ represents a 2-valent group obtained by removing 2 hydrogen atoms from any of a linear or branched alkane having 1 to 15 carbon atoms, and a cyclic or polycyclic alkane having 6 to 12 carbon atoms unsubstituted or having a linear or branched alkyl group having 1 to 9 carbon atoms, and $X^3$ represents a 2-valent group obtained by removing 2 hydrogen atoms from any of a linear or branched alkane having 1 to 15 carbon atoms, and a cyclic or polycyclic alkane having 6 to 12 carbon atoms unsubstituted or having a linear or branched alkyl group having 1 to 9 carbon atoms.

3. The electrophotographic photosensitive member according to claim 1, wherein $X^1$ represents a 2-valent group obtained by removing 2 hydrogen atoms from a linear or branched alkane having 2 to 18 carbon atoms, $X^2$ represents a 2-valent group obtained by removing 2 hydrogen atoms from a linear or branched alkane having 1 to 15 carbon atoms, and $X^3$ represents a 2-valent group obtained by removing 2 hydrogen atoms from a linear or branched alkane having 1 to 15 carbon atoms.

4. The electrophotographic photosensitive member according to claim 1, wherein $X^1$ represents a 2-valent group obtained by removing 2 hydrogen atoms from a linear or branched alkane having 2 6 carbon atoms, $X^2$ represents a 2-valent group obtained by removing 2 hydrogen atoms from a linear or branched alkane having 1 to 3 carbon atoms, and $X^3$ represents a 2-valent group obtained by removing 2 hydrogen atoms from a linear or branched alkane having 1 3 carbon atoms, provided that the total number of carbon atoms in $X^2$ and $X^3$ is 2 to 4.

5. The electrophotographic photosensitive member according to claim 1, wherein the hole transporting compound having a triphenylamine backbone is a compound represented by formula (3):

$$(P^1)_aZ \quad (3)$$

where $P^1$ represents a group represented by formula (4) or formula (5); "a" represents an integer of 2 to 4, and $P^1$s may be the same or different; Z represents a hole transporting group, and a hydrogenated product in which a binding moiety of Z and $P^1$ is replaced with a hydrogen atom is a compound represented by formula (6) or formula (7):

(4)

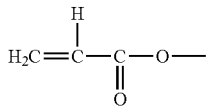

(5)

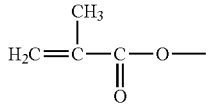

(6)

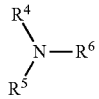

where $R^4$, $R^5$ and $R^6$ represent a phenyl group which may have an alkyl group having 1 to 6 carbon atoms as a substituent; and $R^4$, $R^5$ and $R^6$ may be each the same or different; and (7)

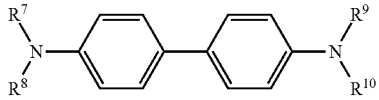

where $R^7$, $R^8$, $R^9$ and $R^{10}$ represent a phenyl group which may have an alkyl group having 1 to 6 carbon atoms as a substituent; and $R^7$, $R^8$, $R^9$ and $R^{10}$ may be each the same or different.

6. The electrophotographic photosensitive member according to claim 1, wherein $0.05 \leq Mb/(Ma+Mb) \leq 0.50$ when content mass of the hole transporting compound contained in the surface layer is designated as Ma and content mass of the compound represented by formula (1) or formula (2) contained in the surface layer is designated as Mb.

7. A method for producing an electrophotographic photosensitive member comprising a support and a surface layer on the support, the method comprising:

preparing a coating liquid for a surface layer, the coating liquid comprising a hole transporting compound having an acryloyloxy group or a methacryloyloxy group and having a triphenylamine backbone, and a compound represented by formula (1) or formula (2), and forming a coating film of the coating liquid for a surface layer, and curing the coating film to thereby form a surface layer:

(1)

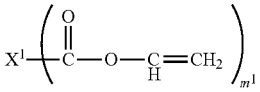

where $m^1$ represents 2 and $X^1$ represents a 2-valent group obtained by removing 2 hydrogen atoms from any of a linear or branched alkane having 2 to 18 carbon atoms, a cyclic or polycyclic alkane having 6 to 12 carbon atoms unsubstituted or having a linear or branched alkyl group having 1 to 12 carbon atoms, and an arene having 6 to 12 carbon atoms unsubstituted or having a linear or branched alkyl group having 1 to 12 carbon atoms, provided that the number of carbon atoms in $X^1$ is 2 to 18; and (2)

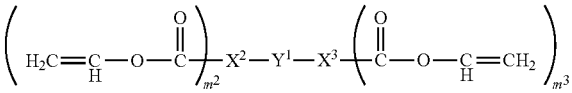

where $m^2$ represents 1, $m^3$ represents 1, and $Y^1$ represents an oxygen atom or a sulfur atom, $X^2$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, and $X^3$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, provided that the total number of carbon atoms in $X^2$ and $X^3$ is 2 to 16.

8. A process cartridge detachably attachable to a main body of an electrophotographic apparatus, the process cartridge integrally supporting:

an electrophotographic photosensitive member, and at least one unit selected from the group consisting of a charging unit that charges the electrophotographic photosensitive member, a developing unit that develops an electrostatic latent image formed on a surface of the electrophotographic photosensitive member, by a toner, to form a toner image on the surface of the electrophotographic photosensitive member, a transferring unit that transfers the toner image from the surface of the electrophotographic photosensitive member to a transfer material, and a cleaning unit that cleans the surface of the electrophotographic photosensitive member, the electrophotographic photosensitive member comprising:

a support, and a photosensitive layer on the support; and a surface layer of the electrophotographic photosensitive member comprising a copolymerized product of a hole transporting compound having an acryloyloxy group or a methacryloyloxy group and having a triphenylamine backbone, and a compound represented by formula (1) or formula (2):

(1)

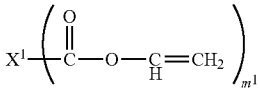

where $m^1$ represents 2 and $X^1$ represents a 2-valent group obtained by removing 2 hydrogen atoms from any of a linear or branched alkane having 2 to 18 carbon atoms, a cyclic or polycyclic alkane having 6 to 12 carbon atoms unsubstituted or having a linear or branched alkyl group having 1 to 12 carbon atoms, and an arene having 6 to 12 carbon atoms unsubstituted or having a linear or branched alkyl group having 1 to 12 carbon atoms, provided that the number of carbon atoms in $X^1$ is 2 to 18; and (2)

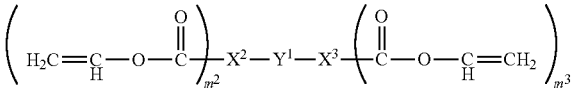

where $m^2$ represents 1, $m^3$ represents 1, and $Y^1$ represents an oxygen atom or a sulfur atom, $X^2$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, and $X^3$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, provided that the total number of carbon atoms in $X^2$ and $X^3$ is 2 to 16.

9. An electrophotographic apparatus comprising:

an electrophotographic photosensitive member, and a charging unit that charges the electrophotographic photosensitive member, an exposure unit that irradiates a surface of the electrophotographic photosensitive member with exposure light to form an electrostatic latent image on the surface of the electrophotographic photosensitive member, a developing unit that develops the electrostatic latent image by a toner to form a toner image on the surface of the electrophotographic photosensitive member, and a transferring unit that transfers the toner image from the surface of the electrophotographic photosensitive member to a transfer material, the electrophotographic photosensitive member comprising:

a support, and a photosensitive layer on the support, wherein a surface layer of the electrophotographic photosensitive member comprises a copolymerized product of a hole transporting compound having an acryloyloxy group or a methacryloyloxy group and having a triphenylamine backbone, and a compound represented by formula (1) or formula (2):

(1)

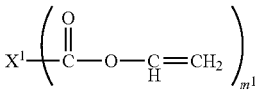

where $m^1$ represents 2 and $X^1$ represents a 2-valent group obtained by removing 2 hydrogen atoms from any of a linear or branched alkane having 2 to 18 carbon atoms, a cyclic or polycyclic alkane having 6 to 12 carbon atoms unsubstituted or having a linear or branched alkyl group having 1 to 12 carbon atoms, and an arene having 6 to 12 carbon atoms unsubstituted or having a linear or branched alkyl group having 1 to 12 carbon atoms, provided that the number of carbon atoms in $X^1$ is 2 to 18; and (2)

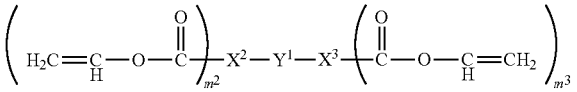

where $m^2$ represents 1, $m^3$ represents 1, and $Y^1$ represents an oxygen atom or a sulfur atom, $X^2$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, and $X^3$ represents a 2-valent group obtained by removing 2 hydrogen atoms from any of a linear or branched alkane having 1 to 15 carbon atoms, a cyclic or polycyclic alkane having 6 to 12 carbon atoms unsubstituted or having a linear or branched alkyl group having 1 to 9 carbon atoms, and an arene having 6 to 12 carbon atoms unsubstituted or having a linear or branched alkyl group having 1 to 9 carbon atoms, provided that the total number of carbon atoms in $X^2$ and $X^3$ is 2 to 16.

* * * * *